US007806562B2

(12) United States Patent
Behr et al.

(10) Patent No.: US 7,806,562 B2
(45) Date of Patent: Oct. 5, 2010

(54) LIGHTING DEVICE COMPRISING AT LEAST ONE LIGHT-EMITTING DIODE AND VEHICLE HEADLIGHT

(75) Inventors: Gerhard Behr, Altheim (DE); Peter Helbig, Sontheim/Brenz (DE); Thomas Reiners, Bachhagel (DE); Ralf Vollmer, Heidenheim (DE)

(73) Assignee: OSRAM Gesellschaft mit beschraenkter Haftung, Munich (DE)

( * ) Notice: Subject to any disclaimer, the term of this patent is extended or adjusted under 35 U.S.C. 154(b) by 244 days.

(21) Appl. No.: 11/792,417

(22) PCT Filed: Jan. 12, 2005

(86) PCT No.: PCT/DE2005/002171

§ 371 (c)(1),
(2), (4) Date: Jun. 6, 2007

(87) PCT Pub. No.: WO2006/066531

PCT Pub. Date: Jun. 29, 2006

(65) Prior Publication Data

US 2008/0130308 A1 Jun. 5, 2008

(30) Foreign Application Priority Data

Dec. 22, 2004 (DE) ..... 10 2004 062 989

(51) Int. Cl.
*F21V 29/00* (2006.01)

(52) U.S. Cl. ..... 362/294; 362/547; 362/373

(58) Field of Classification Search ..... 362/294, 362/373, 545, 547, 800, 249.02; 361/703
See application file for complete search history.

(56) References Cited

U.S. PATENT DOCUMENTS

| | | | | |
|---|---|---|---|---|
| 6,276,822 | B1 * | 8/2001 | Bedrosian et al. | 362/545 |
| 6,773,138 | B2 * | 8/2004 | Coushaine | 362/656 |
| 6,787,999 | B2 * | 9/2004 | Stimac et al. | 315/51 |
| 6,827,468 | B2 * | 12/2004 | Galli | 362/294 |
| 7,004,609 | B2 * | 2/2006 | Behr et al. | 362/549 |
| 7,198,387 | B1 * | 4/2007 | Gloisten et al. | 362/294 |
| 7,314,296 | B2 * | 1/2008 | Machi et al. | 362/470 |
| 7,401,945 | B2 * | 7/2008 | Zhang | 362/249 |
| 7,521,872 | B2 * | 4/2009 | Bruning | 315/158 |
| 2002/0125839 | A1 | 9/2002 | Yen | |

(Continued)

FOREIGN PATENT DOCUMENTS

DE 102 35 699 2/2004

(Continued)

OTHER PUBLICATIONS

English abstract for JP 2000040408A.

(Continued)

*Primary Examiner*—Stephen F Husar
*Assistant Examiner*—Peggy A. Neils

(57) ABSTRACT

A lighting device includes at least one light-emitting diode and a cooling aggregate (400) for cooling the at least one light-emitting diode, wherein the at least one light-emitting diode is arranged on the cooling aggregate (400) and the cooling aggregate (400) is provided with at least one recess in which a mounting plate (408) equipped with electrical components is located. Also described is a vehicle headlight including at least one lighting device of the aforementioned kind.

18 Claims, 6 Drawing Sheets

U.S. PATENT DOCUMENTS

Figure 1:
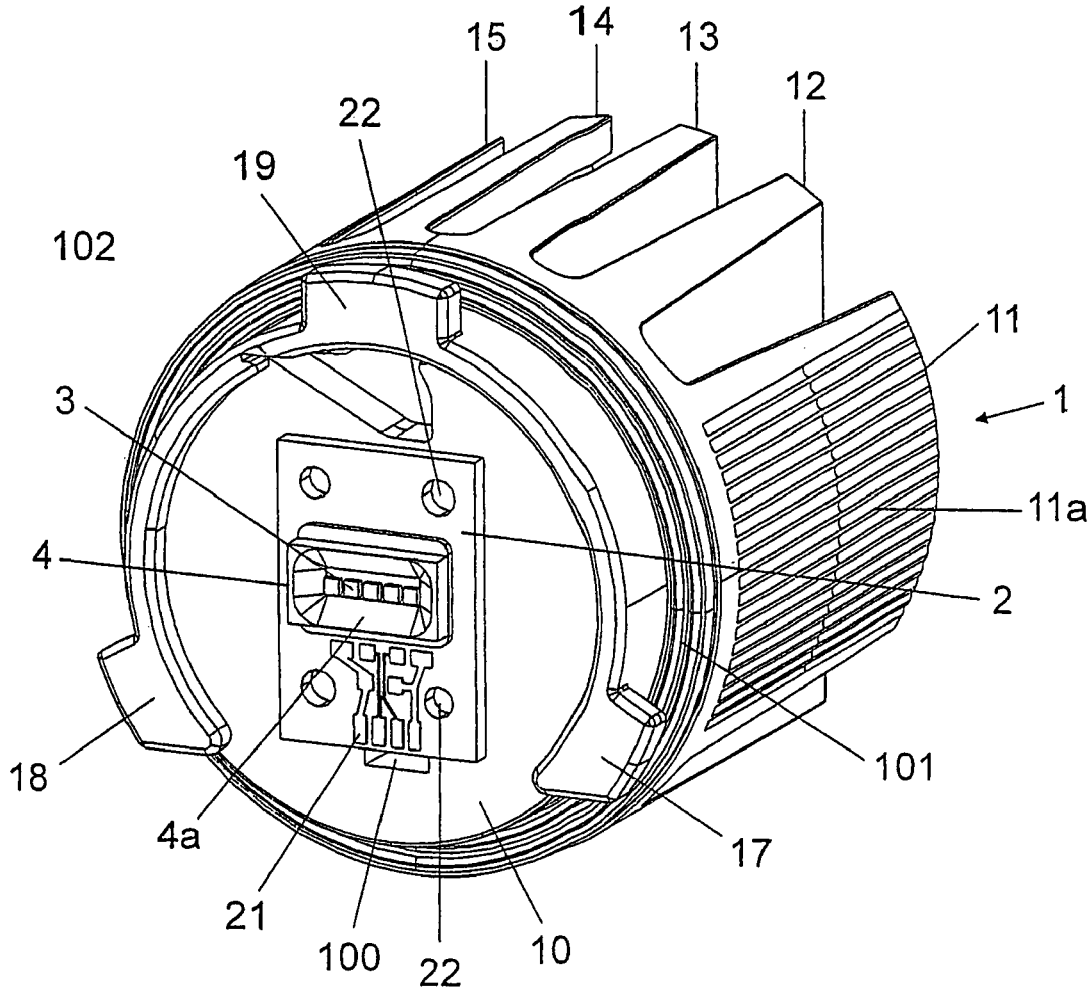

| | | | | |
|---|---|---|---|---|
| 2002/0176250 | A1 * | 11/2002 | Bohler et al. | 362/236 |
| 2004/0053191 | A1 | 3/2004 | Plank | |
| 2004/0190285 | A1 | 9/2004 | Galli | |

FOREIGN PATENT DOCUMENTS

| | | | |
|---|---|---|---|
| EP | 1298382 | * | 4/2002 |
| EP | 1298382 | | 4/2003 |
| JP | 2000040408 | A | 2/2000 |
| JP | 2004206947 | A | 7/2004 |

OTHER PUBLICATIONS

English abstract for JP 2004206947A.

* cited by examiner

LIGHTING DEVICE COMPRISING AT LEAST ONE LIGHT-EMITTING DIODE AND VEHICLE HEADLIGHT

The invention relates to an illumination device in accordance with the precharacterizing clause of patent claim 1 and to a vehicle headlight having at least one such illumination device.

I. PRIOR ART

Such an illumination device has been disclosed, for example, in EP-A 1 298 382. This specification describes an illumination device having two or more light-emitting diodes which are arranged on a heat sink and optics as well as an electrical module for operating the light-emitting diodes. This illumination device is envisaged for use in a vehicle and as a replacement for a conventional incandescent lamp.

II. SUMMARY OF THE INVENTION

It is the object of the invention to provide a generic illumination device which has a design which is as compact as possible and heat dissipation which is as effective as possible for the heat generated by the illumination device.

This object is achieved according to the invention by the features of patent claim 1. Particularly advantageous embodiments of the invention are described in the dependent patent claims.

The illumination device according to the invention has at least one light-emitting diode and a heat sink for the at least one light-emitting diode, the heat sink having at least one cutout, in which a mounting plate is arranged which is fitted with electrical components. This provides a compact design since the electrical components used for operating the at least one light-emitting diode are arranged in the cutout in the heat sink. The cutout in the heat sink provides similarly effective protection for the electrical components arranged on the mounting plate as a conventionally used housing surrounding the components. Owing to the contact between the mounting plate and the heat sink, the heat generated by the electrical components is emitted to the heat sink. The heat sink of the illumination device according to the invention is used both for cooling the light-emitting diodes arranged on it and for cooling the electrical components which are required for operating the light-emitting diodes and are arranged on the mounting plate. The arrangement of the electrical components on a mounting plate, for example a lead frame, has the advantage that the mounting plate fitted in this manner can be mounted as a unit on the heat sink.

In accordance with one preferred exemplary embodiment of the invention, the heat sink has cooling ribs for the purpose of increasing its surface area in order to optimize the cooling effect, the cutout for the mounting plate fitted with the electrical components being arranged in the region of the cooling ribs. This ensures a greater physical distance between the two heat sources on the heat sink, namely the light-emitting diodes and the electrical components. In particular, this means that the light-emitting diodes are not heated by the heat generated by the electrical components. In the abovementioned preferred exemplary embodiment, one of the cooling ribs is advantageously provided with the at least one cutout for the mounting plate fitted with the electrical components or one of the cooling ribs is replaced by the mounting plate fitted with the electrical components. The mounting plate is thus aligned so as to run parallel between two cooling ribs, and this optimizes the cooling of the electrical components arranged on the mounting plate, in particular if a cooling gas stream is passed through between the cooling ribs by means of a blower.

In accordance with the abovementioned preferred exemplary embodiment of the invention, the electrical connection of the illumination device is likewise arranged on the mounting plate in order to ensure a compact design. In accordance with another preferred exemplary embodiment of the invention, the electrical connection of the illumination device is arranged in a further cutout in the heat sink in order to intercept the mechanical load brought about when the electrical contact is used by means of the heat sink and not to transfer it to the mounting plate, which is arranged behind said heat sink, with the electrical components mounted thereon.

The heat sink of the illumination device according to the invention is advantageously provided with means for mounting the illumination device in the correct position in a vehicle headlight. This makes it possible to adjust the at least one light-emitting diode arranged on the heat sink with respect to the optical system of the vehicle headlight since the at least one light-emitting diode is preferably arranged and aligned on the heat sink in a defined position and orientation with respect to the heat sink, as is described, for example, in the German patent application having the official file reference 10 2004 052 687.7.

The abovementioned means for mounting the illumination device in the correct position are preferably formed as part of a bayonet-type lock between the illumination device and the vehicle headlight. The bayonet-type lock ensures that the illumination device is fixed securely in the vehicle headlight owing to the plugging and rotary movement required for latching purposes. The stops for the abovementioned plugging and rotary movement ensure that the at least one light-emitting diode is oriented in the correct position with respect to the vehicle headlight reflector. In addition, the illumination device is in contact with the vehicle headlight reflector above the bayonet-type lock such that said vehicle headlight reflector likewise contributes to the heat dissipation. In accordance with one preferred exemplary embodiment of the invention, the electrical connection of the illumination device has at least one contact web which extends perpendicularly with respect to the axis of the rotary movement of the bayonet-type lock, with the result that, owing to the rotary movement when the bayonet-type lock is latched or unlatched, the electrical contact between the at least one contact web and its opposing contact on the vehicle headlight is produced or released. Electrical contact is thus made with the illumination device in the vehicle headlight at the same time as the bayonet-type lock is actuated. No additional intervention, such as plugging on a plug etc., is therefore required to make electrical contact with the illumination device.

The illumination device according to the invention is preferably envisaged for use as a light source in a headlight of a motor vehicle. Two or more of the illumination devices according to the invention are preferably arranged in the vehicle headlight, each of the illumination devices interacting with a specific part of the optical system of the vehicle headlight in order to produce corresponding light distributions, such as the light distribution for a parking light, a lower beam, an upper beam or a foglight, by switching on a specific combination of these illumination devices arranged in the vehicle headlight.

III. DESCRIPTION OF THE PREFERRED EMBODIMENTS

Figure 2:
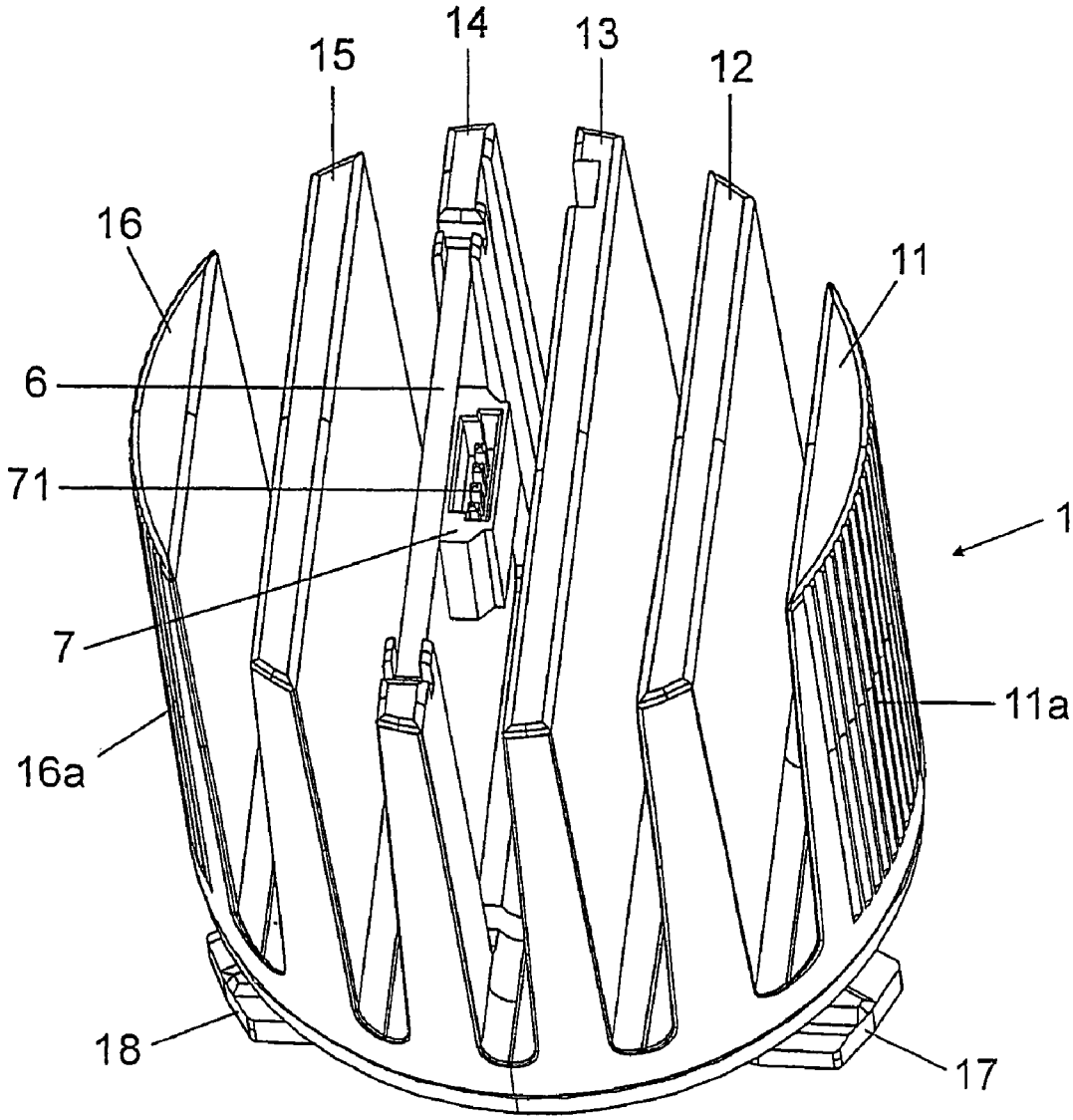
Figure 3:
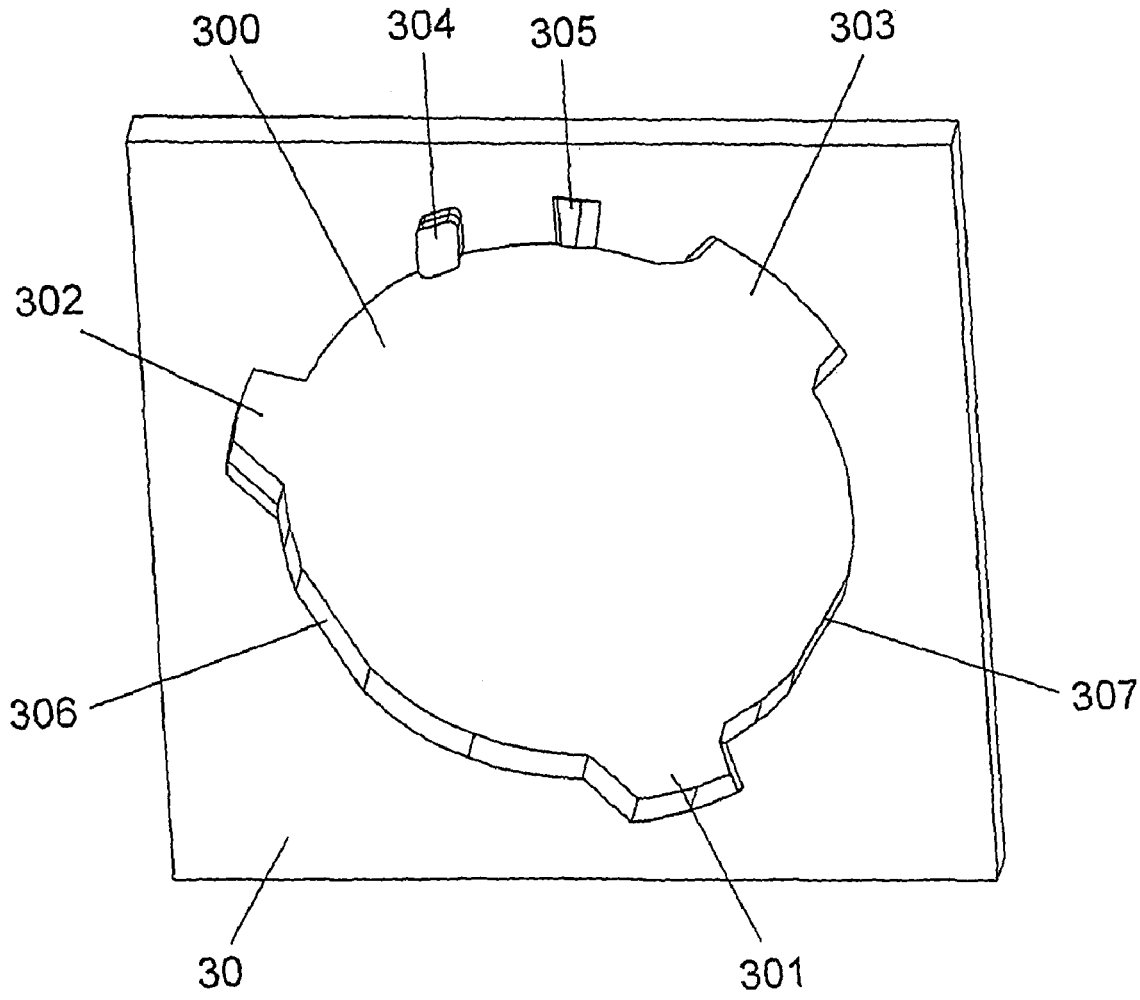
Figure 4:
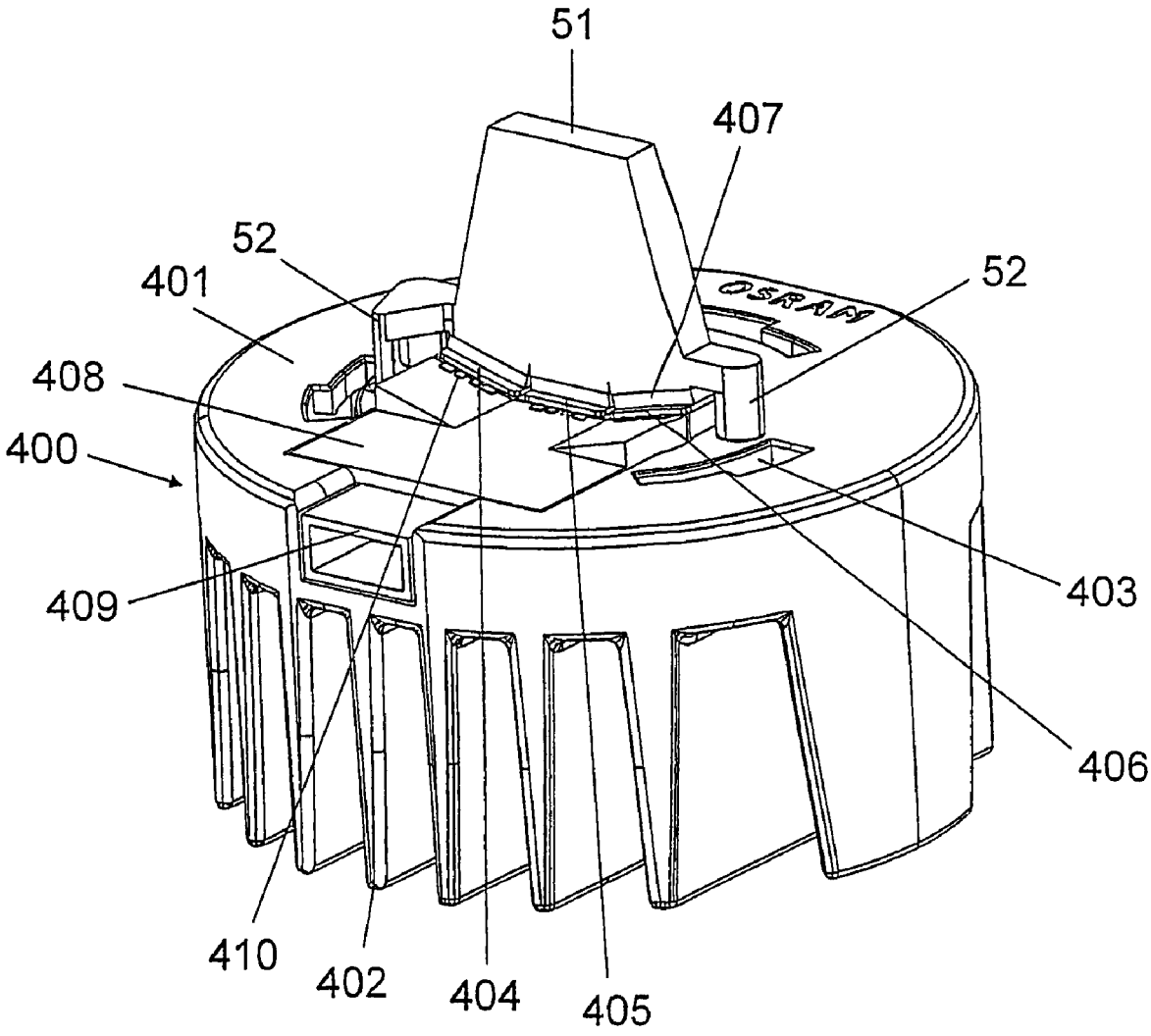
Figure 5:
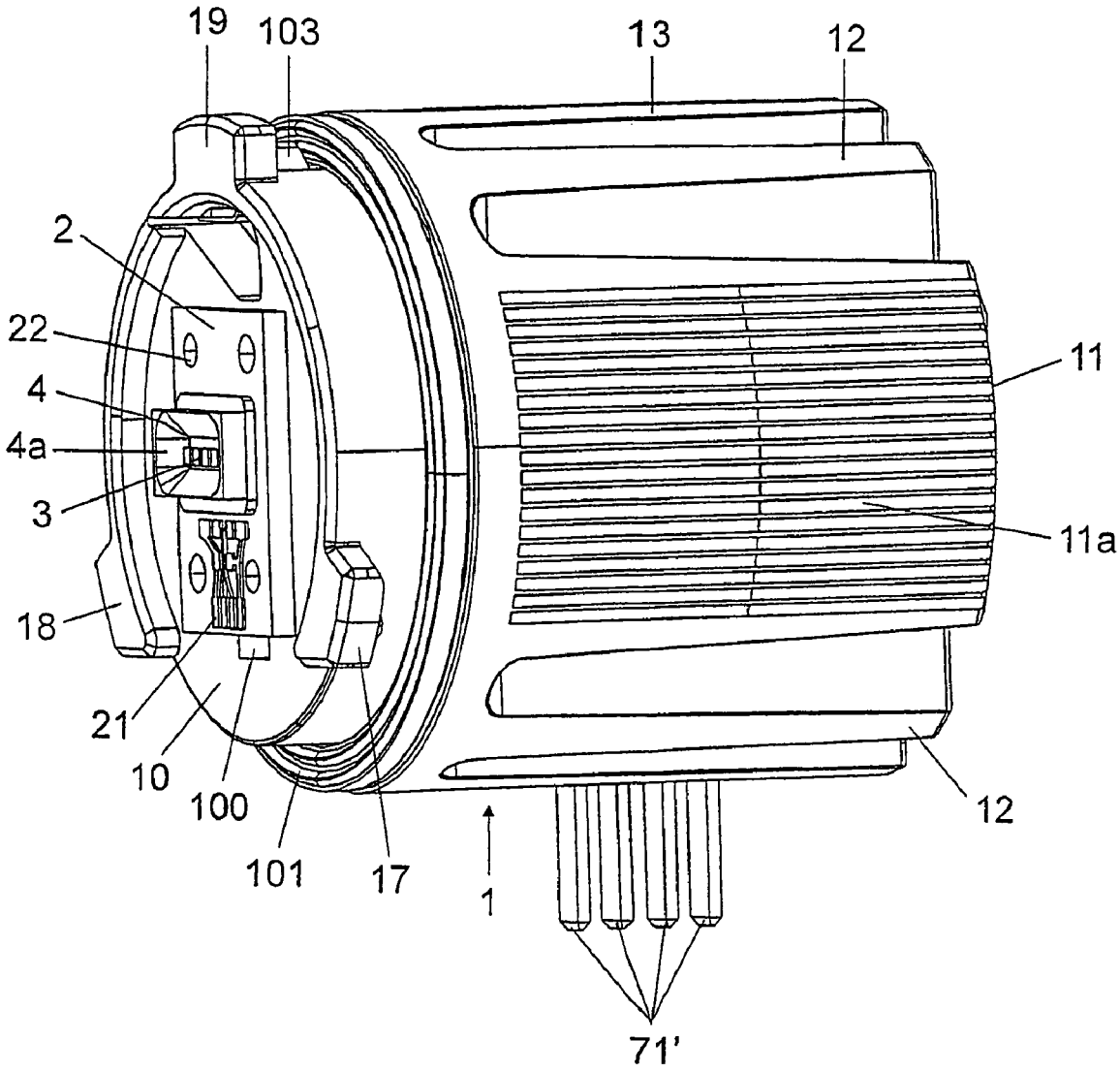
Figure 6:
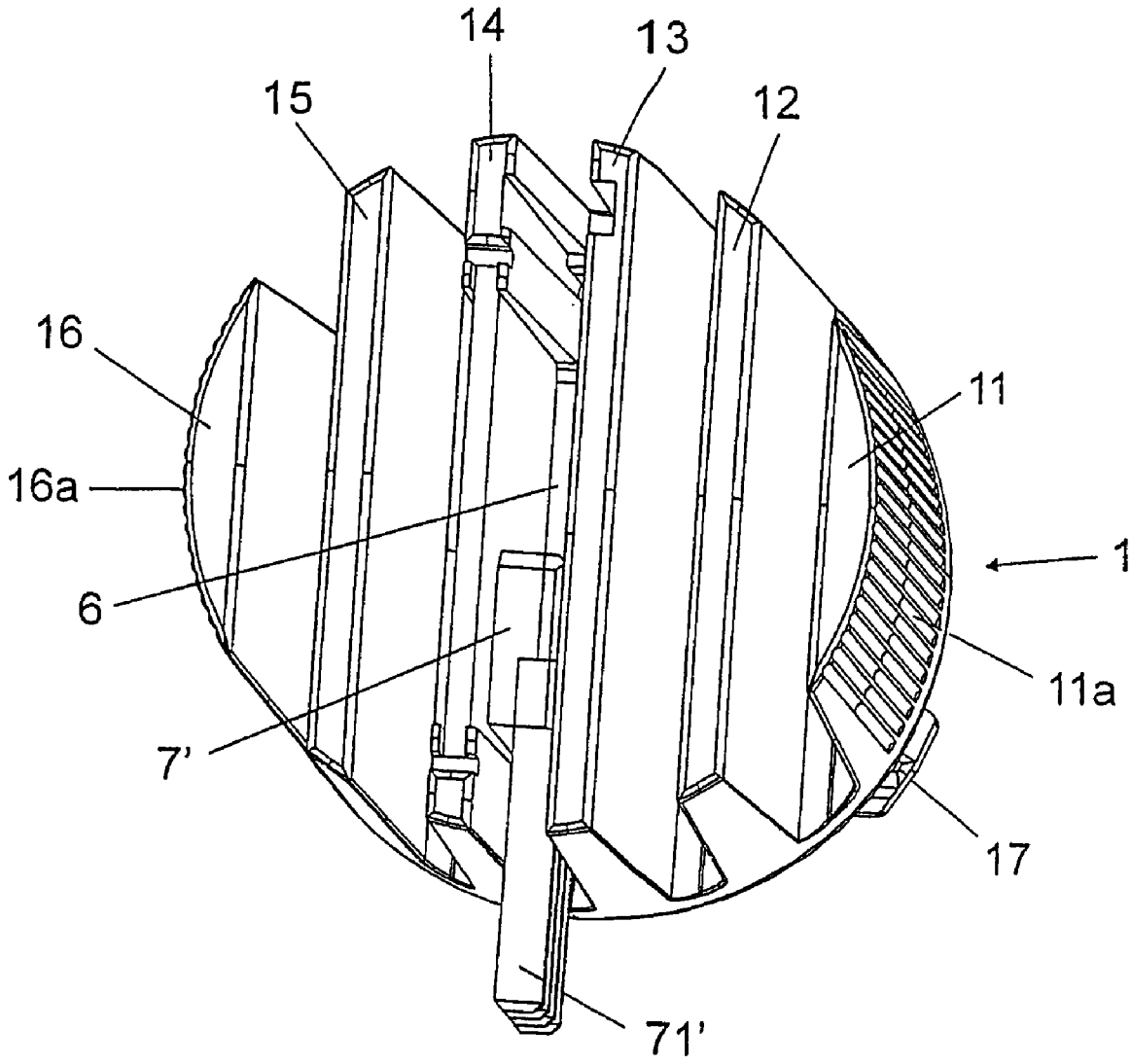

The invention will be explained in more detail below with reference to a few preferred exemplary embodiments. In the drawing:

FIG. 1 shows a plan view of the front of an illumination device in accordance with the first exemplary embodiment of the invention, FIG. 2 shows a plan view of the rear of the illumination device in accordance with the first exemplary embodiment of the invention, FIG. 3 shows an illustration of the mounting opening in the vehicle headlight which matches the exemplary embodiments depicted in FIGS. 1, 2, 5 and 6, FIG. 4 shows a side view of an illumination device in accordance with the second exemplary embodiment of the invention, FIG. 5 shows a side view of an illumination device in accordance with the third exemplary embodiment of the invention, and FIG. 6 shows a plan view of the rear of the illumination device in accordance with the third exemplary embodiment of the invention.

FIGS. 1 and 2 show the illumination device in accordance with the first exemplary embodiment. This illumination device has a heat sink 1 having a mounting surface 10 in the form of a circular disk and parallel cooling ribs 11, 12, 13, 14, 15, 16 which extend perpendicularly with respect to the mounting surface 10. The heat sink 1 is in the form of an integral aluminum die-cast part. The outer contour of the heat sink 1 essentially corresponds to that of a circular cylinder, apart from the cavities between the cooling ribs 11 to 16 and the latching tabs 17, 18, 19, which are part of a bayonet-type lock between the illumination device and a vehicle headlight. The three latching tabs 17, 18, 19 are arranged equidistantly along the circumference of the circular-cylindrical mounting surface 10 at a distance of 120 degrees. They point radially outwards. The two latching tabs 17, 18 have the same design but are arranged in mirror-symmetrical fashion with respect to the diameter of the mounting surface 10, which runs centrally through the third latching tab 19. The latching tab 19 has a different shape than the first latching tab 17 and the second latching tab 18 in order to ensure a definite orientation and installed position of the illumination device in the vehicle headlight. The two cooling ribs 11 and 16 arranged outside have a profile 11*a* or 16*a* on their outer surface in order to ensure that they can be gripped better on actuation of the bayonet-type lock. Next to the latching tab 19, the mounting surface 10 has a depression 102 in order to provide space for mounting a lateral contact-pressure spring 103, which acts perpendicularly with respect to the axis of the rotary movement of the bayonet-type lock. The contact-pressure spring 103 is arranged between the latching tab 19 and the spring ring 101. It is hidden in the illustration in FIG. 1 by the latching tab 19.

A carrier plate 2, for example a so-called metal-core printed circuit board, for in total five light-emitting diode chips 3 (also referred to as LED chips) is fixed on the mounting surface 10 of the heat sink 1. The metal-core printed circuit board 2 is a metal plate which is provided with electrical insulation, for example made from ceramic. Conductor tracks 21 are arranged on the electrical insulation of the metal-core printed circuit board 2 for the purpose of making electrical contact with the LED chips 3. The carrier plate or metal-core printed circuit board 2 ensures electrical insulation between the metallic heat sink 1 and the LED chips 3. The carrier plate 2 is anchored, for example mechanically, on the mounting surface 10 of the heat sink 1 by means of a clamping fit in a cutout in the heat sink 1 or by means of a latching connection or with the aid of an adhesive compound. In order to align and mount the carrier plate 2 in the correct position on the mounting surface 10 of the heat sink 1, two holes, for example, can be introduced into the mounting surface 10, in each case one appropriately shaped pin on the underside of the carrier plate 2 engaging in said holes. These holes can also define the alignment and installed position of the carrier plate 2 with respect to the latching tabs 17 to 19. The five light-emitting diode chips 3 are arranged in a row on the carrier plate 2 and are surrounded by the walls of a so-called casting trough 4 such that the row comprising the five light-emitting diode chips 3 is arranged on the bottom of the casting trough 4. The casting trough 4 is partially filled with a transparent casting compound covering the light-emitting diode chips 3 which contains, for example, two different fluorescent materials in order to convert the wavelength of some of the electromagnetic radiation generated by the light-emitting diode chips 3 such that the illumination device emits white light during its operation. Such fluorescent materials are described, for example, in WO 98/12757. The surface 4*a*, which faces the light-emitting diode chips 3, of the walls of the casting trough 4 is designed so as to reflect light. The light-emitting diode chips 3 are, for example, thin-film light-emitting diode chips, whose basic principle is described, for example, in the document I. Schnitzer et al., Appl. Phys. Lett. 63 (16), Oct. 18, 1993, 2174-2176. The five light-emitting diode chips 3 form, together with the casting compound and the fluorescent materials integrated therein, five light-emitting diodes.

The carrier plate 2 has four holes 22, in each case one appropriately matching pin 52 of primary optics 5 (depicted in FIG. 4) or a holder for the primary optics 5 engaging in said holes 22. As a result, the primary optics 5 are fixed on the carrier plate 2 by means of the pins 52 and its installed position and orientation with respect to the carrier plate 2 and thus also with respect to the latching tabs 17 to 19 is fixed. The holes 22 are preferably arranged such that they fit over corresponding holes in the mounting surface 10 of the heat sink 1 such that the pins 52 of the primary optics 5 are passed through the holes 22 in the carrier plate 2 and engage in the abovementioned holes in the heat sink 1. As a result, in addition to the primary optics 5, the carrier plate 2 is also fixed to the heat sink 1 and aligned by means of the aligning pins 52. In this case, no separate means are required for the carrier plate 2 for the purpose of fixing it on the mounting surface 10 of the heat sink 1. In order to set the distance of the primary optics 5 above the light-emitting diode chips 3 located therebeneath to the correct value, one or more spacers can be provided between the primary optics 5 and the carrier plate 2 or the mounting surface 10, said spacers limiting the penetration depth of the pins 52 in the holes 22. The primary optics are a compound optical concentrator which is of similar design to the optical concentrator 5 of the exemplary embodiment of the invention depicted in FIG. 4. One end of this optical concentrator 5 engages in the casting trough 4 and is coupled optically to the light-emitting diode chips 3 by means of Canada balsam, for example. The optical concentrator 5 focuses the light generated by the light-emitting diode chips 3 such that it emerges from the end side 51, which is remote from the light-emitting diode chips 3, of the concentrator 5 with reduced divergence. The optical concentrator 5 is, for example, a compound parabolic concentrator (CPC) or a compound elliptic concentrator (CEC) or a compound hyperbolic concentrator (CHC). The primary optics 5 are arranged in a well defined position and orientation with respect to the light-emitting diode chips 3 on the heat sink 1 or on the carrier plate 2. The primary optics 5 match the optics of the vehicle headlight (secondary optics). The electrical components required for operating the light-emitting diode chips 3 are arranged on a mounting plate 6 in the form of a lead frame. The mounting plate 6 fitted with the abovementioned electrical components (not depicted) is arranged and fixed in an appropriate cutout in the central cooling rib 14. The electrical components mounted on the mounting plate 6 protrude into the intermediate space between the mounting plate 6 and the adjacent cooling ribs 13 and/or 15. In addition, the electrical connection 7 of the illumination device is mounted on the mounting plate 6. The electrical connection 7 is in the form of a socket having contact pins 71 which is provided for the purpose of receiving a plug matching it. The electrical components arranged on the mounting plate 6 are supplied with electrical energy by means of the socket 7. The power supply circuit, comprising the abovementioned electrical components, of the light-emitting diode chips 3 is electrically conductively connected to the light-emitting diode chips 3 by means of power supply lines (not depicted) which are passed through the aperture 100 in the mounting surface 10 and with which contact is made with the conductor tracks 21 on the carrier plate 2.

FIG. 3 shows a schematic of a holder 30 for the exemplary embodiments of the illumination device according to the invention depicted in FIGS. 1, 2, 5 and 6. This holder 30 is part of the vehicle headlight and is located, for example, on the rear of the vehicle headlight reflector which is remote from the light exit opening of the vehicle headlight reflector. For example, a holder 30 having the mounting opening 300 illustrated in FIG. 3 may be provided on the rear of the abovementioned reflector. The rim of the mounting opening 300 is provided with appropriate cutouts 301, 302, 303 for the latching tabs 17, 18, 19 of the illumination device. In addition, a stop 304 for the latching tab 19 and a ramp 305 are arranged at the rim of the mounting opening 300. The mounting opening 300 with the cutouts 301 to 303 and the stop 304 as well as the ramp 305 form, together with the latching tabs 17 to 19, a bayonet-type lock between the illumination device and the holder 30 of the vehicle headlight. In order to actuate the bayonet-type lock, the illumination device is plugged with its mounting surface 10, which forms the front side of the illumination device protruding into the reflector of the vehicle headlight, onto the holder 30, the latching tab 19 engaging in the cutout 303, the latching tab 17 engaging in the cutout 301 and the latching tab 18 engaging in the cutout 302, and the front side 10 of the illumination device including the latching tabs 17 to 19 passing through the mounting opening 300 such that the rear of the holder 30 bears against the spring ring 101 on the heat sink 1. Owing to a rotary movement, the illumination device is rotated with respect to the section 30 through approximately a quarter rotation such that the latching tab 19 slides over the ramp 305 and bears against the stop 304. The stop 304 prevents a further rotary movement in the screw-in direction. The ramp 305 makes a rotary movement more difficult in the unscrewing direction and prevents automatic unlatching of the bayonet-type lock. The contact-pressure spring 103 bears against the rim of the mounting opening 300 with a clamping fit in the region between the stop 304 and the ramp 305. Owing to the spring action of the contact-pressure spring 103, the illumination device is pressed against the rim regions 306, 307, which run obliquely with respect to one another, of the mounting opening such that the illumination device is supported on three sections of the rim of the mounting opening 300 and is thus secured against movements in the flange plane. The holder 30 or the rim of the mounting opening 300 is arranged with a clamping fit between the latching tabs 17 to 19 and the spring ring 101 in the latched state of the bayonet-type lock. The three latching tabs 17 to 19 lie in a common plane which forms a reference plane for the alignment of the light-emitting diode chips 3 and the primary optics 5 on the reflector of the vehicle headlight. This means that the alignment of the light-emitting diode chips 3 and the primary optics 5 with respect to the heat sink 1 ensures, in conjunction with the above-described bayonet-type lock between the holder 30 and the illumination device according to the invention, a clearly defined installed position of the light source or light sources in the vehicle headlight.

FIG. 4 illustrates an illumination device in accordance with a second exemplary embodiment of the invention. This illumination device has a heat sink 400 having a mounting surface 401 in the form of a circular disk and parallel cooling ribs 402 which extend perpendicularly with respect to the mounting surface 401. The heat sink 400 is in the form of an integral aluminum die-cast part. The outer contour of the heat sink 400 essentially corresponds to that of a circular cylinder, apart from the cavities between the cooling ribs 402. Three depressions 403 in the surface of the heat sink 400 are arranged along a circle on the mounting surface 401 at an angular distance of 120 degrees. These depressions 403 are part of a bayonet-type lock between the illumination device and the vehicle headlight, into which the illumination device is inserted. Three carrier plates 404, 405, 406 for in each case five light-emitting diode chips (also referred to as LED chips) are fixed on the mounting surface 401. The carrier plates 404, 405, 406 are arranged in a row such that in total fifteen light-emitting diode chips are arranged in a row on the front 401 of the heat sink 400. The two outer carrier plates 404, 406 are in each case mounted on a slope of the mounting surface 401 of the heat sink 400. As is described in the first exemplary embodiment (FIG. 1), the light-emitting diode chips are arranged in a casting trough 407 and are hidden in the illustration in FIG. 4 by the primary optics 5. The primary optics 5 have two or more integrally formed journals or aligning pins 52, by means of which it is anchored in holes in the heat sink 400. The primary optics 5 engage in the casting troughs 407, are optically coupled to the light-emitting diode chips arranged in the casting troughs 407, and their physical position and alignment is adjusted with respect to the carrier plates 404 to 406 by means of the journals or aligning pins 52. The light generated by the light-emitting diodes emerges from the light exit opening 51 of the primary optics 5 with reduced divergence. The electrical components for operating the light-emitting diode chips are mounted on a mounting plate 408 in the form of a lead frame which is arranged in a cutout in the heat sink 400 in the region of the mounting surface 401. The mounting plate 408 covers the abovementioned cutout in the heat sink 400. It is practically in the form of a lid for this cutout. The electrical components are mounted on the underside of the mounting plate 408 such that the electrical components protrude into the cutout. In the illustration in FIG. 4, the upper side of the mounting plate 408 can be seen. The depth of the abovementioned cutout matches the physical height of the electrical components mounted on the mounting board 408. An electrical connection, in the form of a socket 409, of the illumination device is arranged in a second cutout at the edge of the mounting surface 401. The electrical components mounted on the mounting plate 408 are supplied with electrical energy via the contact pins of the socket 409. The circuit arrangement formed by the electrical components on the mounting plate 408 serves the purpose of supplying power to the light-emitting diode chips. Electrical contacts 410 are provided at that edge of the mounting plate

408 which faces the carrier plates 404, 405, 406 for the purpose of making contact with the light-emitting diode chips arranged on the carrier plates 404 to 406.

The primary optics 5 of the illumination device match the downstream secondary optics of the vehicle headlight. The secondary optics may be a reflector, for example a free-form surface reflector, an optical lens system or a combination of an optical lens system and a reflector.

FIGS. 5 and 6 illustrate a third exemplary embodiment of the illumination device according to the invention. This illumination device is largely identical to the illumination device in accordance with the first exemplary embodiment, which is depicted in FIGS. 1 and 2. The same references are therefore also used in the corresponding FIGS. 1 and 2 and 5 and 6 for identical parts of the two exemplary embodiments. For the description of these parts, reference is made to the description of the corresponding parts of the first exemplary embodiment. The illumination device in accordance with the third exemplary embodiment differs from that in accordance with the first exemplary embodiment only by the different design of the electrical connection 7'. The electrical connection 7' of the illumination device is mounted on the mounting plate 6. It has four metallic contact webs 71' which are arranged in the cavity between the cooling ribs 13 and 14 and extend in the radial direction of the essentially circular-cylindrical heat sink 1. In particular, the contact webs 71' run parallel to the cooling ribs 11 to 16 and protrude beyond the coolings ribs 11 to 16 such that the free ends of the contact webs 71' protrude from the heat sink 1. When the illumination device is mounted in the mounting opening 300 in the holder 30 (FIG. 3), i.e. during the latching of the bayonet-type lock, the contact webs 71' are rotated into the contact-making position with their opposing contacts on the vehicle headlight. Owing to the latching of the bayonet-type lock, the electrical contact between the illumination device and the supply system voltage of the vehicle is thus also produced. When the bayonet-type lock is unlatched, the electrical contact for power supply purposes is accordingly also automatically interrupted.

The invention is not restricted to the exemplary embodiments explained above. For example, light-emitting diodes emitting colored light can also be used instead of the light-emitting diode emitting white light in order to use the illumination device as a light source in rear lights in the vehicle, for example as a braking light, a reversing light or an indicator etc.

The invention claimed is:

1. An illumination device having at least one light-emitting diode and a heat sink for the purpose of cooling the at least one light-emitting diode, wherein said heat sink has cooling ribs and at least one cutout, in which a mounting plate is arranged which is fitted with electrical components used for operating said at least one light-emitting diode, wherein said at least one cutout and said mounting plate are arranged in the region of the cooling ribs, and wherein said heat sink is used both for cooling the at least one light-emitting diode and for cooling the electrical components.

2. The illumination device as claimed in claim 1, wherein an electrical connection is required to supply electrical energy to the electrical components, and said heat sink has at least one further cutout for the electrical connection of the illumination device.

3. The illumination device as claimed in claim 1, wherein one of the cooling ribs is provided with the at least one cutout, the mounting plate being arranged in the at least one cutout.

4. The illumination device as claimed in claim 2, wherein said electrical connection of the illumination device is arranged on the mounting plate.

5. The illumination device as claimed in claim 1, wherein said at least one light-emitting diode is arranged and aligned in a defined position and orientation with respect to the heat sink.

6. The illumination device as claimed in claim 1, wherein said heat sink is provided with means for mounting the illumination device in the correct position in a vehicle headlight.

7. The illumination device as claimed in claim 6, wherein said means are formed as part of a bayonet-type lock between the illumination device and the vehicle headlight.

8. The illumination device as claimed in claim 7, wherein an electrical connection is required to supply electrical energy to the electrical components, and said electrical connection of the illumination device has at least one contact web which extends perpendicularly with respect to the axis of the rotary movement of the bayonet-type lock, with the result that, owing to the rotary movement when the bayonet-type lock is latched or unlatched, the electrical contact between the at least one contact web and its opposing contact on the vehicle headlight is produced or released.

9. A vehicle headlight having at least one illumination device as claimed in claim 1.

10. The illumination device as claimed in claim 3, wherein an electrical connection is required to supply electrical energy to the electrical components, and said electrical connection of the illumination device is arranged on the mounting plate.

11. The illumination device as claimed in claim 5, wherein said heat sink is provided with means for mounting the illumination device in the correct position in a vehicle headlight.

12. A vehicle headlight having at least one illumination device as claimed in claim 2.

13. A vehicle headlight having at least one illumination device as claimed in claim 3.

14. A vehicle headlight having at least one illumination device as claimed in claim 4.

15. A vehicle headlight having at least one illumination device as claimed in claim 5.

16. A vehicle headlight having at least one illumination device as claimed in claim 6.

17. A vehicle headlight having at least one illumination device as claimed in claim 7.

18. A vehicle headlight having at least one illumination device as claimed in claim 8.

* * * * *

UNITED STATES PATENT AND TRADEMARK OFFICE

CERTIFICATE OF CORRECTION

PATENT NO. : 7,806,562 B2
APPLICATION NO. : 11/792417
DATED : October 5, 2010
INVENTOR(S) : Gerhard Behr et al.

It is certified that error appears in the above-identified patent and that said Letters Patent is hereby corrected as shown below:

Title page item (22) should read as follows:

"December 1, 2005"

Signed and Sealed this
Fifteenth Day of February, 2011

David J. Kappos

David J. Kappos
*Director of the United States Patent and Trademark Office*